US008295517B2

(12) United States Patent
Gottschalk et al.

(10) Patent No.: US 8,295,517 B2
(45) Date of Patent: Oct. 23, 2012

(54) HEARING APPARATUS WITH A COMMON CONNECTION FOR SHIELDING AND IDENTIFICATION OF A RECEIVER

(75) Inventors: Georg Gottschalk, Erlangen (DE); Dietmar Lommel, Poxdorf (DE); Gottfried Rückerl, Nürnberg (DE); Ulrich Schätzle, Forchheim (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 698 days.

(21) Appl. No.: 12/287,185

(22) Filed: Oct. 7, 2008

(65) Prior Publication Data

US 2009/0103754 A1 Apr. 23, 2009

(30) Foreign Application Priority Data

Oct. 18, 2007 (EP) ..... 07020433

(51) Int. Cl.
*H04R 25/00* (2006.01)

(52) U.S. Cl. ..... 381/312; 381/68; 381/120; 381/322; 381/328; 381/317

(58) Field of Classification Search ..... 381/312–331
See application file for complete search history.

(56) References Cited

U.S. PATENT DOCUMENTS

| | | | | |
|---|---|---|---|---|
| 3,493,695 | A * | 2/1970 | Stork | 381/330 |
| 4,701,958 | A * | 10/1987 | Neth | 381/321 |
| 4,815,140 | A * | 3/1989 | Wagner | 381/93 |
| 5,532,649 | A | 7/1996 | Sahyoun | |
| 7,110,562 | B1 * | 9/2006 | Feeley et al. | 381/322 |
| 2002/0172371 | A1 | 11/2002 | Baker et al. | |
| 2003/0179896 | A1 * | 9/2003 | Putvinski | 381/323 |
| 2006/0013432 | A1 | 1/2006 | Husung | |
| 2006/0227988 | A1 * | 10/2006 | Jorgensen et al. | 381/317 |

FOREIGN PATENT DOCUMENTS

| | | | |
|---|---|---|---|
| EP | 1 617 706 | A2 | 1/2006 |
| WO | 0045496 | A2 | 8/2000 |
| WO | 2004025990 | A1 | 3/2004 |
| WO | WO 2005/020549 | A1 | 3/2005 |
| WO | 2007045254 | A1 | 4/2007 |

* cited by examiner

*Primary Examiner* — David Vu
*Assistant Examiner* — Jonathan Han

(57) ABSTRACT

A hearing apparatus with an external receiver is to be made even smaller. Provision is accordingly made for a hearing apparatus with a housing and a receiver device that is removably electrically coupled to the housing, said receiver device having an electronic identification element and having a receiver that is connected to an electrical cable with a sheath cable, with the sheath cable and the electronic identification element being conducted into the housing via a common single-pole connection. As a result of the multiple usage of the single-pole connection for shielding and identification, the female connector of the hearing device and the plug of the receiver device can be made smaller.

19 Claims, 3 Drawing Sheets

HEARING APPARATUS WITH A COMMON CONNECTION FOR SHIELDING AND IDENTIFICATION OF A RECEIVER

CROSS REFERENCE TO RELATED APPLICATIONS

This application claims priority of European Patent Office application No. 07020433.4 EP filed Oct. 18, 2007, which is incorporated by reference herein in its entirety.

FIELD OF INVENTION

The present invention relates to a hearing apparatus with a housing and a receiver device that is removably electrically coupled to the housing, said receiver device having an electronic identification element and having a receiver that is connected to an electrical cable with a sheath cable. The term "hearing apparatus" is understood here to mean any sound-emitting device that can be worn in or on the ear, in particular a hearing device, a headset, a set of ear phones and the like.

BACKGROUND OF INVENTION

Hearing devices are wearable hearing apparatuses which are used to assist the hard-of-hearing. In order to accommodate numerous individual requirements, various types of hearing devices are available such as behind-the-ear (BTE) hearing devices, hearing devices with an external receiver (RIC: receiver in the canal) and in-the-ear (ITE) hearing devices, for example also concha hearing devices or completely-in-the-canal (ITE, CIC) hearing devices. The hearing devices listed as examples are worn on the outer ear or in the auditory canal. Bone conduction hearing aids, implantable or vibrotactile hearing aids are also available on the market. The damaged hearing is thus stimulated either mechanically or electrically.

The key components of hearing devices are principally an input converter, an amplifier and an output converter. The input converter is normally a receiving transducer e.g. a microphone and/or an electromagnetic receiver, e.g. an induction coil. The output converter is most frequently realized as an electroacoustic converter e.g. a miniature loudspeaker, or as an electromechanical converter e.g. a bone conduction hearing aid. The amplifier is usually integrated into a signal processing unit. This basic configuration is illustrated in FIG. 1 using the example of a behind-the-ear hearing device. One or a plurality of microphones 2 for recording ambient sound are built into a hearing device housing 1 to be worn behind the ear. A signal processing unit 3 which is also integrated into the hearing device housing 1 processes and amplifies the microphone signals. The output signal for the signal processing unit 3 is transmitted to a loudspeaker or receiver 4, which outputs an acoustic signal. Sound is transmitted through a sound tube, which is affixed in the auditory canal by means of an otoplastic, to the device wearer's eardrum. Power for the hearing device and in particular for the signal processing unit 3 is supplied by means of a battery 5 which is also integrated in the hearing device housing 1.

As described above, in the case of BTE-RIC hearing devices the loudspeaker is removed from the housing, which is worn behind the ear, and is located directly in the auditory canal when worn. The loudspeaker, which is also referred to as the receiver, is connected to the housing and/or the hearing device via electrical cables. It is possible to connect loudspeakers of different powers to the hearing device in order to compensate for differing severities of hearing loss.

Signals are generally transmitted to the loudspeaker via two electrical cables. A resistance in the hearing device can be measured by means of a third cable. The resistance value indicates the type of loudspeaker and provides corresponding identification information. For adjustment of the hearing device it is necessary to know the type of loudspeaker used and thus to call up the corresponding identification information via the third cable. Therefore in total a three-wire connection to the loudspeaker is required: two cables for the signal and one cable for detecting the type of loudspeaker.

SUMMARY OF INVENTION

The signal cables to the loudspeaker and the loudspeaker itself are known to radiate electrical and magnetic energy. This energy and/or the corresponding fields interfere with the operation of the hearing device. Wireless radio connections in particular are impaired when electromagnetic transmission paths are used in the corresponding hearing devices. The reception coverage for signals and data received externally is considerably reduced with this interference. Particularly affected are remote control commands, wireless transmissions of audio signals, and wireless programming. However the radiation from the signal cables or from the loudspeaker itself also increases the risk of feedback especially when operating the telephone loop.

A simple solution to this radiation problem consists in shielding the interfering fields by means of a sheath cable. However a fourth cable would then be necessary between the hearing device housing and the loudspeaker. However this leads not only to a thicker loudspeaker cable, but also means that a larger cable plug and/or a larger loudspeaker connector are required on the hearing device. However for reasons of space the female connector on the hearing device for the loudspeaker cable should be as small as possible.

The object of the present invention is thus to reduce the overall size of a hearing apparatus with an interchangeable receiver and shielded cables.

This object is inventively achieved by means of a hearing apparatus with a housing and a receiver device that is removably electrically coupled to the housing, said receiver device having an electronic identification element and having a receiver that is connected to an electrical cable with a sheath cable, with the sheath cable and the electronic identification element being conducted into the housing via a common single-pole connection.

In accordance with the present invention it is advantageously possible to deploy one pole of the connection of the receiver on the housing of the hearing apparatus both for the sheath cable and for tapping the identification element. This multiple usage saves one pole, so that one female connector and one plug on the housing for plugging in the receiver device can be made smaller.

The receiver device preferably has a three-pole plug combining two poles for controlling the receiver and one pole for the sheath cable and the identification element. Thus a very small three-pole plug and a three-pole female connector in the hearing device housing can be used for conventional controlling of the receiver.

The identification element can be an ohmic resistor. This represents a highly cost-effective component for identification that can be integrated easily into a plug.

According to another preferred embodiment the single-pole connection for the sheath cable and for the identification element is grounded in the interior of the housing via a capacitor. Thus high-frequency interference portions can be grounded and the identification element can be evaluated on a direct-current basis.

Furthermore the single-pole connection in the interior of the housing can be conducted to an electrical resistor, which in combination with the identification element results in a potentiometer that is evaluated in order to identify the receiver device. This kind of potentiometer represents a reliable and robust means of identification.

According to a further embodiment the single-pole connection in the interior of the housing can be applied to a multiplexer for the receipt of further input signals. For example the multiplexer can also serve as the input for a volume control. With this design of input the signal processing components can be used for several different input channels.

In a special embodiment the sheath cable consists of shielding material. An effective electrical shielding can thus be achieved.

BRIEF DESCRIPTION OF THE DRAWINGS

The present invention is described in more detail with reference to the appended drawings, in which.

DETAILED DESCRIPTION OF INVENTION

The exemplary embodiments shown in more detail below represent preferred embodiments of the present invention.

Figure 1:
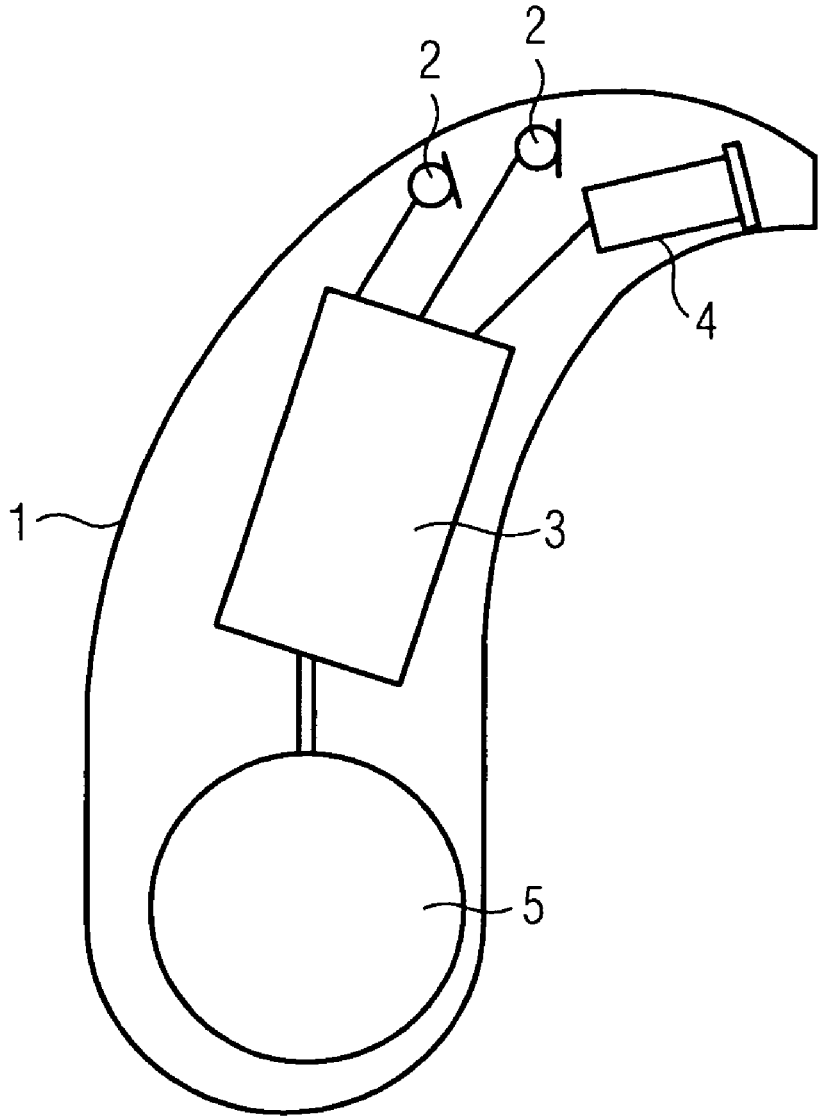
FIG 1 (Prior art)
FIG. 1 shows the basic configuration of a hearing device according to the prior art.
Figure 2:
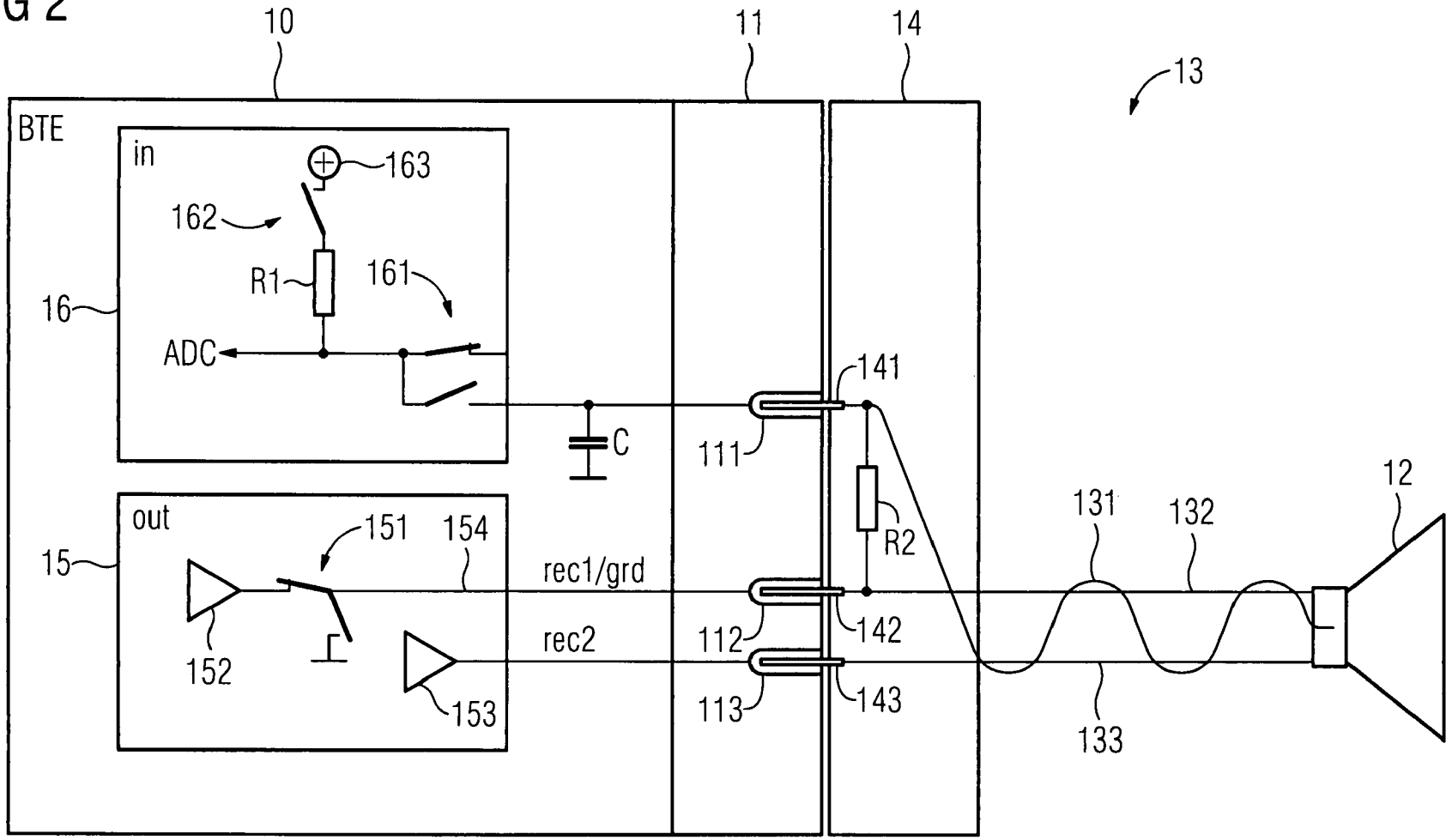
FIG. 2 shows a schematic view of a hearing apparatus according to a first embodiment.

The BTE-RIC (behind-the-ear, receiver in the canal) device shown by way of example in FIG. 2 has a hearing device housing 10 that is worn behind the ear. A female connector 11 is integrated in the housing 10 so that an external receiver 12 can be connected. The receiver 12 is part of a receiver device 13, which is embodied here in the form of a loudspeaker and/or receiver module that can be plugged into the female connector 11. For this purpose the receiver device 13 has a plug 14 with three pins 141, 142 and 143, each of which corresponds to one pole. The female connector 11 has corresponding terminals 111, 112 and 113 for the pins 141, 142 and 143.

The receiver 12 is actuated via two cables 132 and 133, which lead into the pins 142 and 143 of the plug 14. The loudspeaker signals to be transmitted by the hearing device via the two cables 132 and 133 to the receiver 12 are generated within the hearing device housing 10 from an output level 15. In the present example the output level has two amplifiers 152 and 153. In normal operation they supply the output signals via the terminals 112, 113, the pins 142, 143 and the cables 132, 133 to the receiver 12. These actuation signals are referred to in FIG. 2 as rec1 and rec2.

As several different receiver devices 13 each having a certain type of loudspeaker can be plugged into the hearing device and/or the hearing device housing 10, a resistor R2 is integrated into the plug 14. Said resistor is electrically connected to the pins 141 and 142. Therefore in order to identify the receiver device 13 a corresponding input circuit 16 is provided in the interior of the hearing device housing 10. The input circuit 16 here has a multiplexer 161 to which is connected at its first input the terminal 111 of the female connector 11. However further sensors can also be connected to the multiplexer 161: a volume control (not shown), a program button and the like. The output of the multiplexer 161 is conducted to an AD converter (not shown). The output of the multiplexer 161 is further connected via a resistor R1 and a switch 162 to a voltage source 163.

The output level 15 has a switch 151 with which the first output cable 154, which in normal operation conducts the loudspeaker signal rec1, can be separated from the amplifier 152 and grounded so that it conducts the potential grd.

This switch status is used for the identification procedure, and the switch 162 in the input circuit 16 is furthermore moved to the ON position. The multiplexer 161 will automatically and cyclically scan the identification terminal 111. In this status the resistors R1 and R2 represent a potentiometer, the output voltage of which contains identification information relating to the receiver device 13. After identification the switch 151 is moved back again and the switch 162 is opened.

A sheath cable 131 is wound around the loudspeaker cables 132 and 133 for shielding thereof. The sheath cable is connected at one end to the receiver housing 12 and at the other end to the pin 141 of the pole for receiver identification. The sheath cable 131 can possibly also be realized as shielding material around a two-core cable. In order that high-frequency interferences can be conducted away via the sheath cable 131, the pin 141 and the identification terminal 111, the latter is grounded via a capacitor C. As this is AC-effective rather than DC-effective it has no role to play in the identification.

In accordance with the main inventive thought the identification/detection cable for determining the receiver type is simultaneously used as a sheath cable. In this way interfering alternating electromagnetic fields are shielded across the detection pole of the female connector 11 and/or the plug 14. However it is also necessary for the sheath cable to be conducted to the potentiometer potential and not grounded. For this purpose the detection cable, as mentioned, is connected via the capacitor C to a suitable reference potential (preferably ground). This can take place within the hearing device housing with a small capacitor component. For example, the same shielding effect is achieved with a capacitance value of 10 nF as with a separate fourth sheath cable that is shorted to ground.

Figure 3:
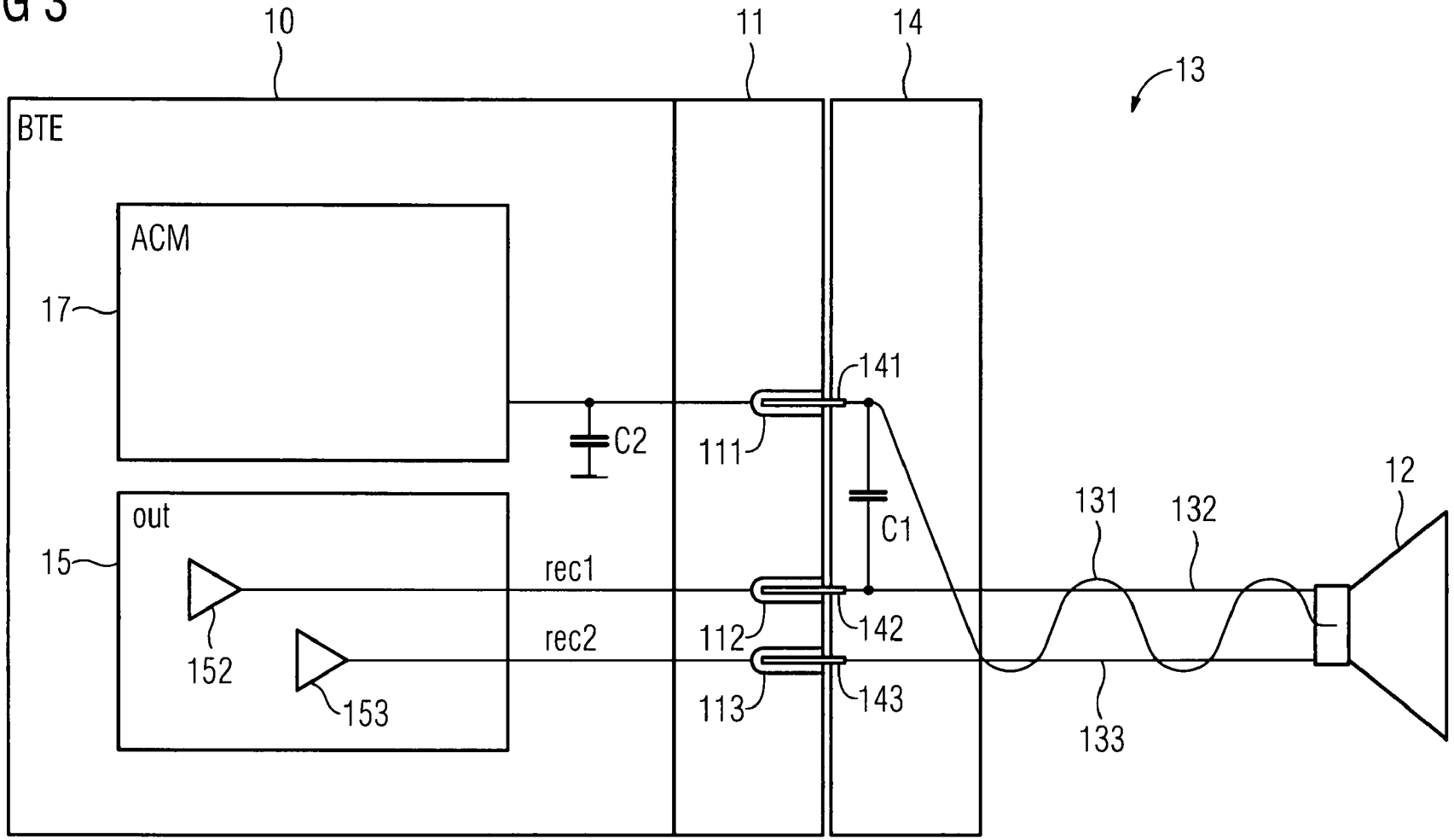
FIG. 3 shows a hearing apparatus according to a second embodiment, also in a schematic view.

FIG. 3 shows an alternative embodiment of the present invention. Most of the components are the same as those of the first exemplary embodiment, and consequently reference is made to the description above for their structure and effect. However, the identification element that is integrated in the plug is not an ohmic resistor but instead a capacitor C1. Thus the detection and identification of the receiver type takes place by means of an AC measurement rather than a DC measurement. Consequently the identification terminal 111 is connected to an AC test circuit 17. The high-frequency interferences that are conducted via the sheath cable 131 into the hearing device are here also conducted away via a capacitor (here referred to as C2). In this exemplary embodiment there is furthermore no need for an input multiplexer and the output level 15 is designed more simply without a switch. This exemplary embodiment is to indicate that the receiver device 13 can also be identified by means of non-resistive components such as capacitors or coils.

The invention claimed is:

1. A hearing apparatus, comprising:

a housing; and a receiver device removably electrically coupled to the housing, the receiver device having an electronic identification element configured to identify during an identification procedure an electrical characteristic of a receiver connected to an electrical cable assembly comprising a first actuation-signal cable, a second actuation-signal cable and a bi-functional, electrically conductive sheath cable, the sheath cable and the electronic identification element connected into the housing via a common single-pole connection, wherein the sheath cable is physically arranged about the first and second cables to electromagnetically shield the first and second cables from electromagnetic interference during normal operation of the hearing apparatus, wherein the electromagnetic shield provided by the sheath cable during the normal operation of the hearing apparatus constitutes a first function provided by the sheath cable, wherein the sheath cable is further arranged to electrically carry during the identification procedure an electrical measurement effective to identify the electrical characteristic of the receiver, wherein electrically-carrying said electrical measurement during the identification procedure constitutes a second function provided by the sheath cable.

2. The hearing apparatus as claimed in claim 1, wherein the receiver device has a three-pole plug with two poles respectively connected to the first and second actuation-signal cables to actuate the receiver and one pole connected to the sheath cable and the identification element.

3. The hearing apparatus as claimed in claim 2, wherein the identification element is an ohmic resistor.

4. The hearing apparatus as claimed in claim 3, wherein the single-pole connection for the sheath cable and for the identification element is grounded in the interior of the housing via a capacitor.

5. The hearing apparatus as claimed in claim 4, wherein the single-pole connection in the interior of the housing is conducted to an electrical resistor, which in combination with the identification element results in a potentiometer that is evaluated in order to identify the receiver device.

6. The hearing apparatus as claimed in claim 5, wherein the single-pole connection in the interior of the housing is applied to a multiplexer for the receipt of further input signals.

7. The hearing apparatus as claimed in claim 4, wherein the single-pole connection in the interior of the housing is applied to a multiplexer for the receipt of further input signals.

8. The hearing apparatus as claimed in claim 3, wherein the single-pole connection in the interior of the housing is conducted to an electrical resistor, which in combination with the identification element results in a potentiometer that is evaluated in order to identify the receiver device.

9. The hearing apparatus as claimed in claim 3, wherein the single-pole connection in the interior of the housing is applied to a multiplexer for the receipt of further input signals.

10. The hearing apparatus as claimed in claim 2, wherein the single-pole connection for the sheath cable and for the identification element is grounded in the interior of the housing via a capacitor.

11. The hearing apparatus as claimed in claim 2, wherein the single-pole connection in the interior of the housing is conducted to an electrical resistor, which in combination with the identification element results in a potentiometer that is evaluated in order to identify the receiver device.

12. The hearing apparatus as claimed in claim 2, wherein the single-pole connection in the interior of the housing is applied to a multiplexer for the receipt of further input signals.

13. The hearing apparatus as claimed in claim 1, wherein the identification element is an ohmic resistor.

14. The hearing apparatus as claimed in claim 1, wherein the single-pole connection for the sheath cable and for the identification element is grounded in the interior of the housing via a capacitor.

15. The hearing apparatus as claimed in claim 1, wherein the single-pole connection in the interior of the housing is conducted to an electrical resistor, which in combination with the identification element results in a potentiometer that is evaluated in order to identify the receiver device.

16. The hearing apparatus as claimed in claim 1, wherein the single-pole connection in the interior of the housing is applied to a multiplexer for the receipt of further input signals.

17. The hearing apparatus as claimed in claim 1, wherein the sheath cable comprises a shielding material.

18. The hearing apparatus as claimed in claim 1, wherein the receiver is a loudspeaker and the electrical characteristic identified during the identification procedure is an impedance of the loudspeaker.

19. A method for establishing a common electrical connection for shielding and identifying a receiver in a hearing apparatus, the method comprising:

removably electrically coupling a receiver device to a housing;

configuring an electronic identification element to identify during an identification procedure an electrical characteristic of a receiver of the receiver device connected to an electrical cable assembly;

arranging the electrical cable assembly to include a first actuation-signal cable, a second actuation-signal cable and a bi-functional electrically-conductive sheath cable;

connecting the sheath cable and the electronic identification element into the housing via a common single-pole connection;

physically arranging the sheath cable about the first and second cables to electromagnetically shield the first and second cables from electromagnetic interference during normal operation of the hearing apparatus, wherein electromagnetically shielding provided by the sheath cable during the normal operation of the hearing apparatus constitutes a first function provided by the sheath cable; and arranging the sheath cable to electrically carry during the identification mode an electrical measurement effective to identify the electrical characteristic of the receiver, wherein electrically carrying said electrical measurement during the identification procedure constitutes a second function provided by the sheath cable.

* * * * *